United States Patent [19]

Stern

[11] Patent Number: 5,053,748

[45] Date of Patent: Oct. 1, 1991

[54] SYSTEM FOR THE SAFE AND SECURE TRANSPORTATION OF VALUABLE ARTICLES, SUCH AS BANK NOTES, CHEQUES

[75] Inventor: Justus Stern, Stockholm, Sweden

[73] Assignee: Inter Innovation AB, Stockholm, Sweden

[21] Appl. No.: 301,011

[22] Filed: Jan. 24, 1989

[30] Foreign Application Priority Data

Dec. 2, 1988 [SE] Sweden ..... 8800472

[51] Int. Cl.[5] ..... G08B 13/14

[52] U.S. Cl. ..... 340/541; 340/568; 364/900; 364/947.2; 364/942.8

[58] Field of Search ... 364/200 MS File, 900 MS File; 340/541, 542, 568; 109/4, 21, 45

[56] References Cited

U.S. PATENT DOCUMENTS

| | | | |
|---|---|---|---|
| 4,363,279 | 12/1982 | Johansson | 109/29 |
| 4,573,043 | 2/1986 | Heuker of Hoek et al. | 340/571 |
| 4,766,419 | 8/1988 | Hayward | 340/545 |
| 4,797,663 | 1/1989 | Rios | 340/691 |
| 4,907,250 | 3/1990 | Ricks | 377/7 |

*Primary Examiner*—Eddie P. Chan
*Assistant Examiner*—Kevin A. Kriess
*Attorney, Agent, or Firm*—Simmons, Perrine, Albright & Ellwood

[57] ABSTRACT

In a system for transporting bank notes between system terminals in a container for valuables, referred to as a cassette, each cassette is provided with an electronic unit or sealing provision. The electronic unit includes a counter (131) and a memory (13). The counter (131) registers a new count each time the cassette is opened. The cassettes can be connected both mechanically and electrically to any of the terminals. An electronic unit in a terminal includes a processor (20), a coding unit (21), a decoding unit (22) and a comparator (23). Before disconnecting a cassette from a terminal, the count of the counter (131) is read by the terminal and is encoded with the respective coding unit (21). The coded value corresponding to the count is then stored in the memory (13) of the cassette. At a second terminal the counter setting and its coded value stored in the memory (13) are read. The coded value is decoded by the decoding unit (22) of the second terminal and is compared to the counter setting by the comparator (23). An agreement between the compared values show that the cassette was not opened in transit. Conversely, an opening in transit occurred if the two compared values do not coincide. During transit the memory (13) contains both the counter setting and its coded value. However, these two values can only be compared when the correct decoding algorithm is known.

4 Claims, 1 Drawing Sheet

SYSTEM FOR THE SAFE AND SECURE TRANSPORTATION OF VALUABLE ARTICLES, SUCH AS BANK NOTES, CHEQUES

TECHNICAL FIELD

The present invention relates to a system for the safe and secure transportation of valuable articles, such as bank notes, cheques, etc., in which system the valuable articles are sent in a cassette from a first system terminal to a second system terminal, and in which the cassette incorporates a miniprocessor which includes a counter and memory facility.

BACKGROUND PRIOR ART

It is known to transport valuable articles, e.g. bank notes, between the various sections of a bank and between separate banks with the aid of cassettes, which may be provided with mechanical or electronic locks, possibly both, to prevent unauthorized opening of the cassettes.

It is also known to combine cassettes with information relating to the cassette and its contents, and also to what shall be done with the contents.

For instance, it is known from Swedish Patent Specification 443,059 to provide a memory facility into which information relating to, for example, the cassette serial number, the type of bank note(s) concerned, the total number of bank notes in the cassette, the width of these bank notes, and the value thereof, can be written and read out.

Furthermore, the Swedish Patent Specification No. 449 935 teaches a system which includes a counter facility and a memory facility for counting and data storage of the number of bank notes present and optionally also the value of the bank notes, and in which the counter and memory facilities are in the form of units incorporated in an electronic data card, which also incorporates cassette identification units, units for registering the number of withdrawals from and deposits into the cassette, a unit for recording the times at which certain operations were carried out, and optionally a unit for blocking access to the cassette contents before/after a given time.

However, despite what has been said in the aforegoing, practically all transportation of valuable articles is carried out traditionally, where information concerning the transported articles is recorded on ancillary documents or paper sheets. This information will vary with different consignments, although generally speaking each transportation of valuable articles will include the following papers or documents: A draft or bill specifying the contents; a voucher which contains information regarding what shall be done with the consignment; a receipt which is used to confirm receipt of the assignment; and also some form of seal, which will guarantee that the consignment, or dispatch, has not been opened unnoticed by an unauthorized person.

As beforementioned, electronic cassettes used in the transportation of valuable articles can be programmed to contain various kinds of information on a long term basis. Such electronic cassettes can also contain the information normally found on the aforesaid documents used in the traditional manner of transportation. There then remains the question of adequate security against illegal or unauthorized manipulation of the information inserted into the cassette memory, and also against theft or misappropriation of the cassette contents. It is therefore essential to ensure that the cassette is sealed, and particularly electronically sealed, so that any unauthorized attempt to interfere with the cassette or its contents will be discovered.

The object of the invention is to provide a system for the safe and secure transportation of valuables, e.g. bank notes, with which the aforesaid drawbacks are eliminated and which will afford a high degree of security.

DISCLOSURE OF THE INVENTION

In accordance with the invention, in a system for the safe and secure transportation of valuables from a first terminal to a second terminal with the aid of cassettes, the cassettes are provided with counters which are operative in counting the number of times that a respective cassette is opened.

The first terminal is provided with read means for reading the number prevailing in the cassette counter at that time, means for coding the number read from the counter, and means for inserting this coded number into the cassette memory.

The second terminal has means for reading the coded number stored in the cassette memory, means for decoding the coded number read from said memory, and means for making a comparison between the decoded number and the number registered in the cassette counter.

As will be understood, both the first and the second terminals will, in practice, have coding and decoding means, means for writing-in and reading out said numerical values and for effecting a comparison between these values. The system may also include a plurality of such transport terminals spread over a wide area, e.g. over a town or city.

BRIEF DESCRIPTION OF THE DRAWINGS

The invention will now be described in more detail with reference to the accompanying schematic drawing, in which.

DESCRIPTION OF A PREFERRED EMBODIMENT

Figure 1:
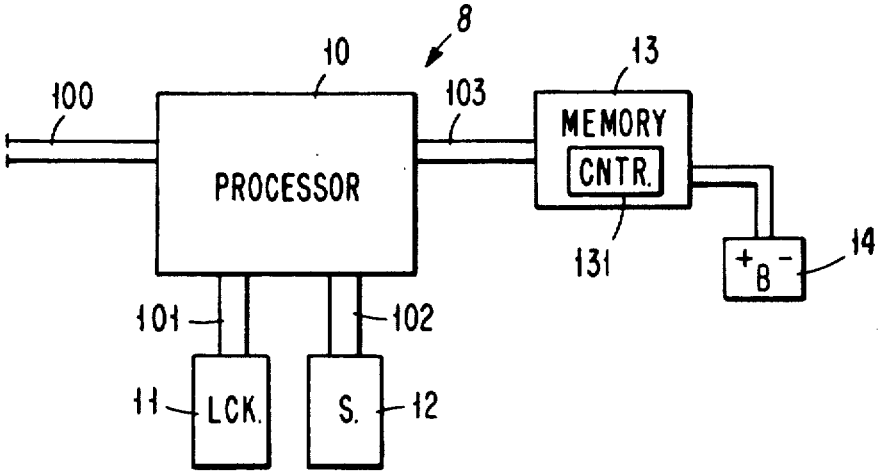
FIG. 1 illustrates electronic units included in a cassette.

FIG. 1 illustrates electronic units included in the equipment of a box or cassette (designed generally by numeral 8) namely a processor ("PROCESSOR") 10, an electronic lock ("LCK.") 11, a sensor means ("S") 12, a memory facility ("MEMORY") 13 with counter ("CNTR.") 131, and a battery ("B") 14.

Signals are sent from the terminal to which the cassette 8 is connected, both mechanically and electrically, along a conductor 100. The processor 10 is able to write information into the memory 13 and read information therefrom, via a conductor 103.

The processor 10 activates the lock 11 for unlocking of the cassette 8, via a conductor 101. Opening of the cassette 8 is sensed by the sensor 12, which in response hereto sends a signal to the processor 10, which in turn sends a signal to the counter 131 via a conductor 103, instructing the counter to advance one step. This is the only way in which the counter 131 can be stepped forward. The sensor 12 is constructed to cause opening of the cassette 8 to be registered in the counter, even when the cassette 8 is opened in the absence of a preceding signal from the terminal over the conductor 100.

Figure 2:
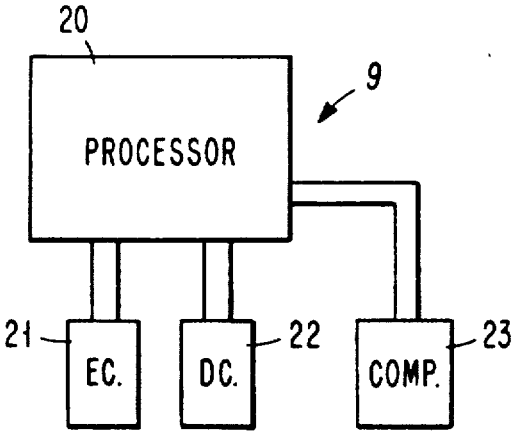
FIG. 2 illustrates electronic units included in one terminal of a multiple of terminals.

FIG. 2 illustrated electronic units included in a terminal (designated generally by the numeral 9) to which the cassette can be connected both mechanically and electrically, namely a processor ("PROCESSOR") 20, a coding unit ("DC.") 21, a decoding unit 22 and a comparator ("COMP.") 23.

The aforementioned electronic sealing function is achieved with the aid of the memory 13 and the counter 131 incorporated in the cassette 8 and through the possibility of coding and decoding information in the respective coding and decoding units 21 and 22 of a cassette 8 and comparing this information in the comparator 23.

This so-called sealing facility is applied in the following manner. When a cassette 8 connected to a terminal has been emptied of or filled with bank notes and shall be disconnected from the terminal 9, the setting of the terminal counter 131 is read-off. Assume this setting to be 0001001. Subsequent to be read-out, this number is coded in the coding unit 21. Assume that the coded number is DF216B5. This numerical figure or coded value is then written into a separate coding area in the memory 13. The cassette 8 now contains both the counter setting and the coded value and the cassette 8 can now be removed from the terminal. These two values can only be compared with one another, when the algorithm used and the correct key is known.

The electronic, seal is checked in the following way. When the cassette 8 is inserted into another terminal 9 in the manner intended, the setting of the counter and the coded value stored in the cassette memory 13 are read-off and the coded value is decoded in the decoding unit 22, whereafter a comparison is made between the coded value and the counter setting. If these two numerical values coincide with one another, then the cassette 8 will not have been opened during transit from the first terminal 9 to the second terminal 9. If the two numerical values do not coincide, then this will indicate that the cassette 8 has been opened during transit; the counter will have been stepped forward one increment with each time of opening the box 8, and hence there will be no agreement between these two values (irrespective of the coding).

It is possible to calculate a new coded value with the aid of means other than an authorized terminal 9. Opening of the cassette 8 outside of the authorized terminal 9 or in a nonauthorized terminal will most definitely result in disagreement between the counter setting and the memory 13, therewith revealing the misappropriation or unauthorized opening of the cassette 8.

I claim:

1. A system including at least two terminals and at least one cassette for the safe and secure transportation of valuables by means of such cassette from a first terminal to a second terminal of the at least two terminals of the system, said at least one cassette including a processor having a counter and a memory facility, characterized in that the memory facility includes a cassette memory (13) and the counter (131) includes means for establishing counter settings corresponding to the number of times that a cassette is opened; in that the system comprises means, disposed at the first terminal, for reading a numerical value of a prevailing counter setting, means for coding the numerical value of the prevailing counter setting and means for inserting the coded numerical value into the cassette memory (13); and in that the system further comprises means, disposed at the second terminal, for reading the coded numerical value from the cassette memory, means for decoding said coded numerical value, and means for comparing the decoded numerical value with the prevailing counter setting of the counter (131).

2. A system for secure transportation of valuables between different terminals, the system including cassettes for containing such valuables in transit between terminals, and at least first and second terminals between which the valuables are to be transported, the system comprising:

in each of such cassettes, a counter, means for advancing the setting of the counter to count the number of times the cassette has been opened, and an electronic memory unit;

in each of the terminals of the system, a processor, a coding unit, a decoding unit, and a comparator circuit; and means, including means for electrically coupling the counter and the memory unit of the cassette to said processor, said coding unit, said decoding unit and said comparator circuit of any selected one of the terminals, for reading a setting of the counter, for coding such setting of the counter and for storing a coded value of the setting in said memory unit of the cassette prior to disconnection of the cassette from a first of the terminals and transport to a second of the terminals of the system, and for reading the counter setting, reading the coded value stored in the memory unit, decoding the coded value and comparing the decoded value with the counter setting after the cassette has been transported from such first terminal to the second terminal of the system, whereby the counter setting coinciding with the decoded value indicates that the cassette has not been opened in transit between the first and second terminals.

3. A system according to claim 2, wherein the at least first and second terminals of the system are a plurality of terminals, the system comprising in each of the terminals, a processor, a coding unit, a decoding unit, and a comparator circuit, and wherein each of said plurality of terminals are capable of being selected as one of said first and second terminals, the system including with each of said first and second terminals said means for reading a setting of the counter, for coding such setting of the counter and for storing a coded value of the setting in said memory unit of the cassette prior to disconnection of the cassette from the first of the terminals and transport to the second of the terminals of the system, and for reading the counter setting, reading the coded value stored in the memory unit, decoding the coded value and comparing the decoded value with the counter setting after the cassette has been transported from such first terminal to the second terminal of the system.

4. A system according to claim 2, wherein the system comprises a further processor, an electronic lock and a battery, in each such cassette of the system, the further processor being coupled to read information from and write information into said memory unit.

* * * * *

UNITED STATES PATENT AND TRADEMARK OFFICE

CERTIFICATE OF CORRECTION

PATENT NO. : 5,053,748

DATED : October 1, 1991

INVENTOR(S) : Justus Stern

It is certified that error appears in the above-identified patent and that said Letters Patent is hereby corrected as shown below:

Column 3, line 7, "a coding unit ("DC") 21, a decoding unit 22 and a" should read --a coding unit ("EC") 21, a decoding unit ("DC") 22 and a--.

Signed and Sealed this

Twelfth Day of January, 1993

*Attest:*

DOUGLAS B. COMER

*Attesting Officer*

*Acting Commissioner of Patents and Trademarks*